US006000263A

United States Patent [19]

Enami

[11] Patent Number: 6,000,263

[45] Date of Patent: Dec. 14, 1999

[54] BRANCH PIPE FORMING TOOL AND METHOD OF FORMING BRANCH PIPE ON METAL TUBE WITH THE TOOL

[75] Inventor: Toshiaki Enami, Kyoto, Japan

[73] Assignee: Enami Seiki Mfg. Co., Ltd., Yao, Japan

[21] Appl. No.: 09/237,399

[22] Filed: Jan. 26, 1999

Related U.S. Application Data

[62] Division of application No. 08/633,590, Apr. 17, 1996.

[30] Foreign Application Priority Data

Jun. 5, 1995 [JP] Japan ..... 7-137854
Jul. 14, 1995 [JP] Japan ..... 7-178649

[51] Int. Cl.[6] ..... B21C 37/29

[52] U.S. Cl. ..... 72/70; 72/117; 72/123

[58] Field of Search ..... 72/113, 115, 117, 72/120, 122, 123, 124, 70

[56] References Cited

U.S. PATENT DOCUMENTS

| | | | |
|---|---|---|---|
| 411,780 | 10/1889 | Brownell | 72/117 |
| 1,670,216 | 5/1928 | Savadow . | |
| 2,045,235 | 6/1936 | Newman . | |
| 2,669,889 | 2/1954 | Hüller . | |
| 3,468,147 | 9/1969 | Davies . | |
| 3,924,432 | 12/1975 | Yarnold | 72/123 |
| 4,400,959 | 8/1983 | Reigner et al. . | |
| 4,413,485 | 11/1983 | Larikka . | |
| 4,414,835 | 11/1983 | Larikka . | |
| 5,000,630 | 3/1991 | Riley et al. . | |

FOREIGN PATENT DOCUMENTS

| | | | |
|---|---|---|---|
| 129093 | 6/1947 | Australia | 72/115 |
| 0322722 | 7/1989 | European Pat. Off. . | |
| 0446089 | 2/1991 | European Pat. Off. . | |
| 1931897 | 2/1970 | Germany . | |
| 3621403 | 4/1987 | Germany . | |
| 57-199527 | 12/1982 | Japan . | |
| 59-190416 | 12/1984 | Japan . | |
| 0858979 | 8/1981 | U.S.S.R. . | |
| 1310077 | 5/1987 | U.S.S.R. . | |

*Primary Examiner*—Lowell A. Larson
*Attorney, Agent, or Firm*—W. F. Fasse; W. G. Fasse

[57] ABSTRACT

A branch pipe is formed on a metal tube using a forming tool including a milling part and a burring part adjacent the milling part. The milling part has a first diameter and is provided with a prescribed cutting edge on its outer peripheral surface. The burring part has a sloping surface with a maximum second diameter larger than the first diameter, and has a slope diameter that gradually diminishes in a direction away from the milling part. The branch pipe forming tool can be used for forming a branch pipe on a metal tube regardless of the shape of the metal tube. In a method of forming a branch pipe on a metal tube with the tool, the milling part is used to form an opening in the wall of the metal tube, the burring part is inserted through the opening into the tube, and then pulled back out of the opening while rotating and revolving along a prescribed path, so that the sloping surface of the burring part outwardly deforms the edge of the opening so as to form the flared flange or branch pipe extending from the metal tube.

7 Claims, 12 Drawing Sheets

BRANCH PIPE FORMING TOOL AND METHOD OF FORMING BRANCH PIPE ON METAL TUBE WITH THE TOOL

CROSS-REFERENCE TO RELATED APPLICATION

This is a DIVISIONAL of U.S. patent application Ser. No. 08/633,590, filed: Apr. 17, 1996.

BACKGROUND OF THE INVENTION

1. Field of the Invention

The present invention relates to a branch pipe forming tool and a method of forming a branch pipe on a metal tube with the tool, and more specifically, it relates to a branch pipe forming tool which can efficiently form a branch pipe on a metal tube with high shape accuracy and a method of forming a branch pipe on a metal tube with the tool.

2. Description of the Background Art

In general, metal tubes are employed as protective tubes or conduits for enclosing wiring cables which are buried under the ground. Among such metal tubes, a metal tube 20 having a branch pipe 20B shown in FIG. 15 is generally employed. The branch pipe 20B can be formed on the metal tube 20 by any of the following four methods, which are well known in the art.

The first method is adapted to form metal parts 20A and 20B shown in FIG. 16, which are half the metal tube 20 having the branch pipe 20*b* shown in FIG. 15 respectively, by press working, and thereafter connecting these metal parts 20A and 20B with each other by welding, thereby forming a metal tube having a branch pipe.

The second method is called "plug passing". As shown in FIG. 17, a plug 110 having a prescribed shape is drawn up from the interior to the exterior of a metal tube 20 along the direction of arrow A while its periphery is heated by high frequency induction heating, thereby outwardly raising up the tube wall and forming a branch pipe 20*b*.

The third method is adapted to form a branch pipe with a swinging tool 120. The swinging tool 120 of a prescribed shape is driven is with a feed f and rotation β as shown in FIG. 18, thereby gradually raising up the tube wall of a metal tube 20 and forming a branch pipe 20*b*.

The fourth method utilizes rubber. As shown in FIG. 19, confining tools 130 and 150 are arranged around a metal tube 20 while rubber 140 is injected into the interior of the metal tube 20 and pressed by plungers 160 from both sides of the metal tube 20, thereby outwardly raising up the tube wall of the metal tube 20 along the shape of the confining tool 130 and forming a branch pipe 20*b*.

However, the aforementioned four methods of forming branch pipes on metal tubes have the following problems respectively.

The first method requires the steps of pressing the metal parts 20A and 20B and connecting these metal parts 20A and 20B with each other. In particular, the pressing step requires molds which are responsive or adapted to the shapes of the metal tube and the branch pipe, which disadvantageously limits the type of the metal tube that can be provided with the branch pipe.

The second method requires the steps of previously forming a prepared hole in the metal tube 20 and setting the plug 110 in this prepared hole, and these steps must be carried out independently of each other. Further, it is necessary to heat the periphery of the plug by high frequency induction heating.

The third method requires the steps of forming a prepared hole in the metal tube and setting the tool in the prepared hole, similarly to the second method.

Finally, the fourth method requires the steps of previously forming a prepared hole in the metal tube, setting the confining tools on the metal tube, injecting the rubber into the metal tube, pressing the injected rubber with the plunger, and removing the rubber and the confining tools. Similarly to the first method, further, this method requires the confining tools which are responsive or adapted to the shapes of the metal tube and the branch pipe, and hence the type of the metal tube that can be provided with the branch pipe is disadvantageously limited.

SUMMARY OF THE INVENTION

An object of the present invention is to provide a branch pipe forming tool which can form a branch pipe on a metal tube regardless of the shape of the metal tube, and a method of forming a branch pipe on a metal tube with the tool.

According to a first aspect of the present invention, a branch pipe forming tool which is employed for forming a branch pipe on a metal tube comprises a milling part and a burring part at one end of the milling part. The milling part has a first diameter and is provided with a prescribed cutting edge on its outer peripheral surface. The burring part has a sloping surface that has a maximum second diameter larger than the first diameter that slopes gradually or smoothly to a reduced diameter in a direction away from the milling part.

According to the first aspect of the present invention, a method of forming a branch pipe on a metal tube using a branch pipe forming tool as described above comprises the steps of forming an opening having a diameter larger than the second diameter of the burring part at a prescribed location on the metal tube using the milling part of the branch pipe forming tool while rotating the milling part on its axis and revolving the same along a prescribed track, and inserting the branch pipe forming tool into the opening and then bringing the sloping surface of the burring part into contact with the edge portion of the opening from the interior of the metal tube and feeding the branch pipe forming tool from the interior of the metal tube toward the exterior while moving the branch pipe forming tool along the edge portion of the opening, thereby raising up the edge portion of the opening and forming a branch pipe.

In using the branch pipe forming tool, and particularly in the method of forming a branch pipe on a metal tube with the tool, according to the first aspect of the present invention, as hereinabove described, a prescribed opening is first formed in the wall of the metal tube with the milling part of the branch pipe forming tool, and then the edge portion of the opening is raised up by means of the sloping surface of the burring part of the branch pipe forming tool.

Thus, the branch pipe can be formed on the metal tube through a series of operations, with efficient productivity.

Consequently, the branch pipe can be formed on the metal tube with a single branch pipe forming tool, whereby M/C ability is improved and working accuracy can further be improved. In addition, the branch pipe can be formed on the metal tube regardless of the size of the metal tube, whereby it is possible to form the branch pipe on the metal tube with no influences exerted by the sizes of the metal tube and the branch pipe.

According to a second aspect of the present invention, a branch pipe forming tool which is employed for forming a branch pipe on a metal tube comprises first and second forming rolls which are arranged on a virtual straight line at a prescribed spacing from one another and directed to outer sides respectively so that peripheral surfaces thereof face toward each other, first and second support bases for supporting the first and second forming rolls, space variable apparatus or means for sliding the first and second support bases along the virtual straight line thereby changing the spacing between the first and second forming rolls, and support base rotation apparatus or means for rotating the first and second support bases for aligning the virtual straight line with rotation axes of the first and second support bases.

According to the second aspect of the present invention, a method of forming a branch pipe on a metal tube using a branch pipe forming tool as described above regarding this second aspect of the invention comprises the steps of preparing a metal tube having a prescribed opening, adjusting the first and second support bases with the support base rotation apparatus so that rotation axes of the first and second forming rolls are perpendicular to the moving direction of the branch pipe forming tool, bringing the first and second forming rolls into contact with the edge portion of the opening of the metal tube by means of the space variable apparatus and feeding or moving the branch pipe forming tool, thereby raising up the edge portion of the opening and forming a branch pipe on the metal tube, and adjusting the first and second support bases with the support base rotation apparatus so that the rotation axes of the first and second forming rolls are along the moving direction of the branch pipe forming tool, for finishing the branch pipe.

In using the branch pipe forming tool, and particularly in the method of forming a branch pipe on a metal tube with the tool, according to the second aspect of the present invention, the first and second forming rolls are brought into contact with the opening of the metal tube while the branch pipe forming tool is fed or moved for forming the branch pipe on the metal tube, and the directions of rotation of the first and second forming rolls are converted by the support base rotators, thereby finishing the branch pipe.

Since the first and second forming rolls are arranged on the same virtual straight line, the branch pipe can be formed while canceling working reactive forces which are applied to the branch pipe forming tool in working of the branch pipe.

Consequently, it is possible to reduce the strength of the structure of the branch pipe forming tool, and of the structure on a work chucking side of the branch pipe forming tool.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS (First Embodiment)

A first embodiment of a branch pipe forming tool and a method of forming a branch pipe on a metal tube with the forming tool according to the present invention is now described with reference to the drawings.

Figure 1A:
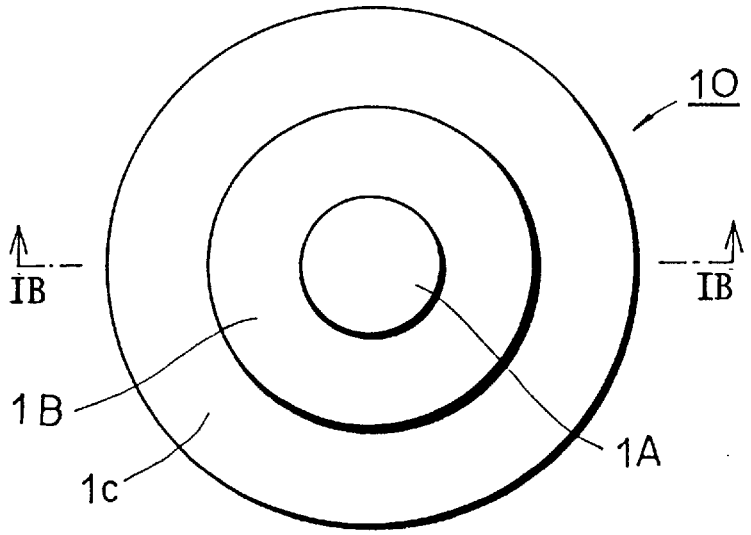
FIGS. 1A and 1B are a plan view and a longitudinal sectional view of a branch pipe forming tool according to a first embodiment of the present invention.
Figure 1B:
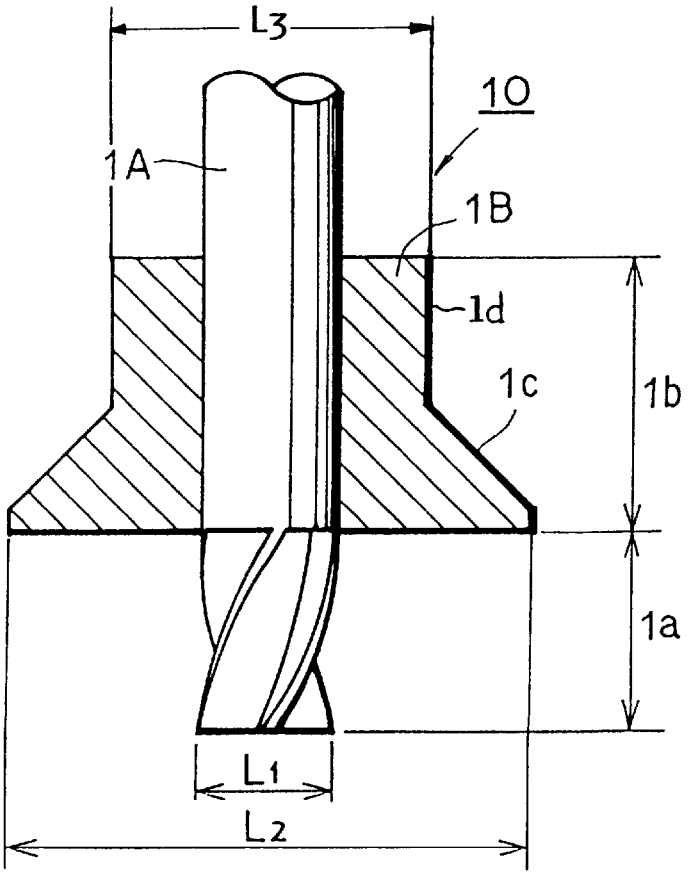

With reference to FIGS. 1A and 1B, the structure of a branch pipe forming tool 10 according to this embodiment is now described. The branch pipe forming tool 10 according to this embodiment comprises a milling part 1*a* and a burring part 1*b*. The milling part 1*a,* which has a diameter $L_1$ and is provided with a prescribed cutting edge on its outer peripheral surface, is formed on a forward end portion of a main shaft 1A according to this embodiment. On the other hand, the burring part 1*b* comprises a slope or sloping surface 1C that has a maximum diameter $L_2$ which is larger than the diameter $L_1$ of the milling part 1*a* and that has a slope diameter which gradually diminishes to a third diameter $L_3$ that is smaller than $L_2$ and preferably still larger than $L_1$, in a direction away from the milling part 1*a* along the axial direction of the main shaft 1A.

According to this embodiment, the milling part 1*a* comprises spiral cutting flutes and a cutting axial end face formed directly on the main shaft 1A while the burring part 1*b* is formed by a member 1B which is different from the main shaft 1A, and the main shaft 1A is thereafter engaged with and fixed to the member 1B. The member 1B here includes a frusto-conical part with the linearly sloping surface 1C thereon, and a cylindrical part with a non-sloping cylindrical surface 1*c*. However, the present invention is not restricted to such a structure but the tool 10 may alternatively be formed as an integrated member by precutting.

A method of forming a branch pipe on a metal tube 20 with the branch pipe forming tool 10 having the aforementioned structure is now described with reference to FIGS. 2A and 2B and FIGS. 3A and 3B.

Figure 2A:
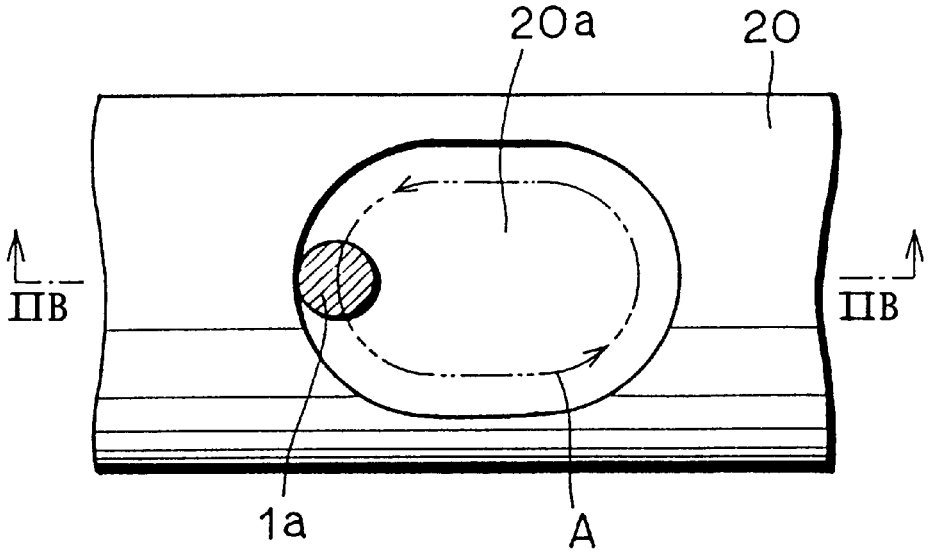
FIGS. 2A and 2B are a plan view and a longitudinal sectional view showing a first step of a method of forming a branch pipe on a metal tube with the branch pipe forming tool according to the first embodiment of the present invention.
Figure 2B:
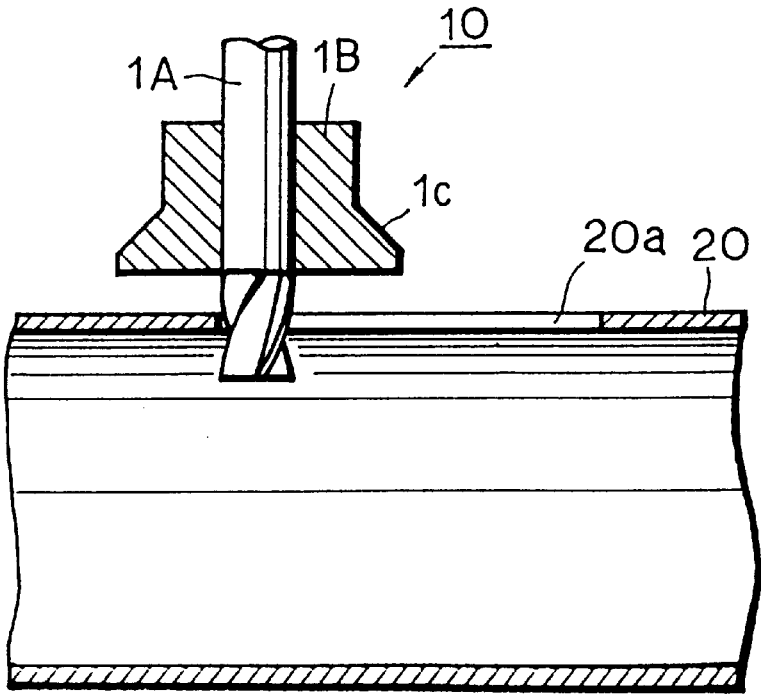

Referring to FIGS. 2A and 2B, the milling part 1*a* of the branch pipe forming tool 10 is set onto and fed into the metal tube 20 at a prescribed location, and is rotated on its own axis while being revolved along a prescribed track A which is an oval path in the illustrated embodiment, thereby forming in the tube 20 an opening 20*a* having a diameter which is larger than the diameter $L_2$ of the burring part 1*b*.

Figure 3A:
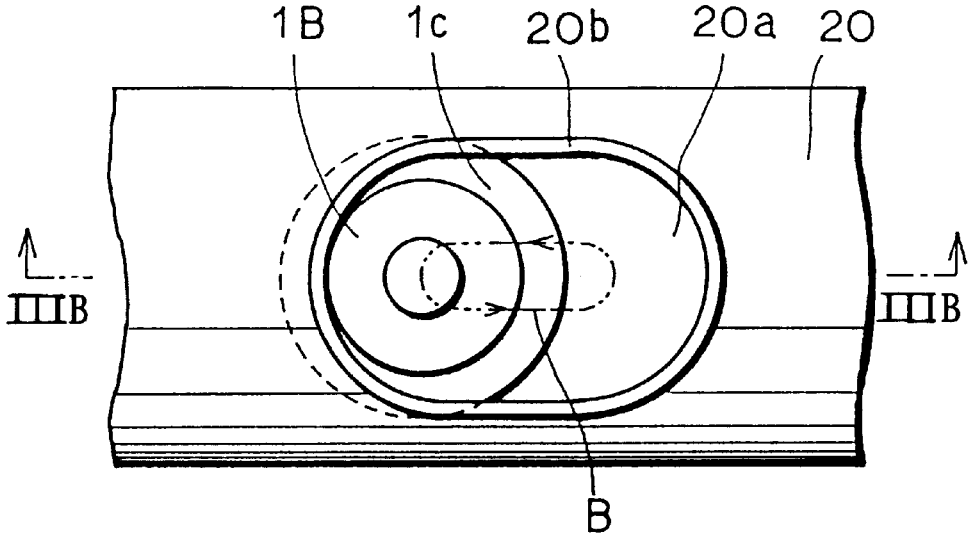
FIGS. 3A and 3B are a plan view and a longitudinal sectional view showing a second step of the method of forming a branch pipe on a metal tube with the branch pipe forming tool according to the first embodiment of the present invention.
Figure 3B:
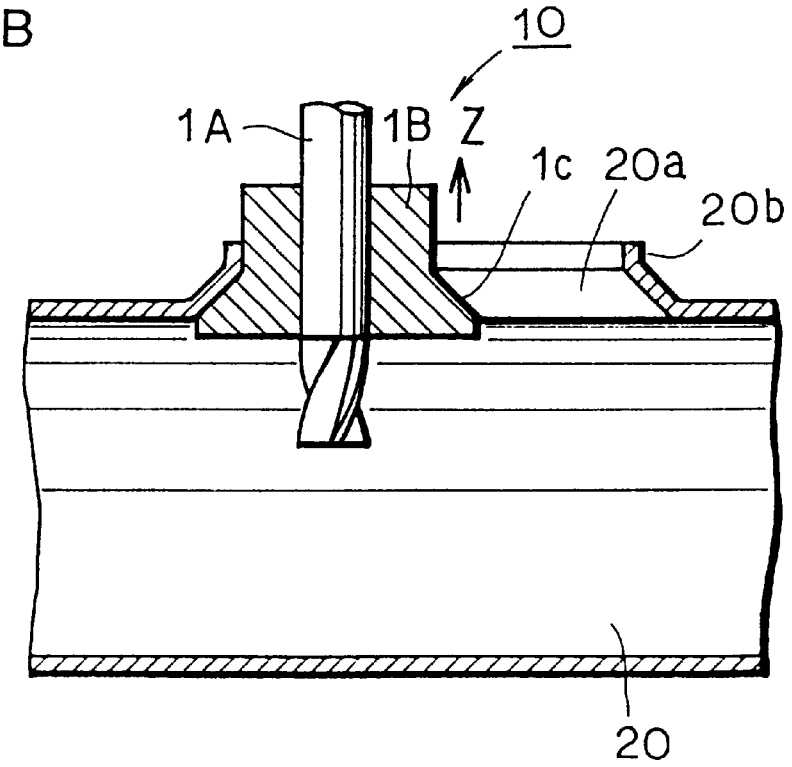

Referring to FIGS. 3A and 3B, the branch pipe forming tool 10 is inserted in the opening 20*a,* so that its sloping surface 1*c* comes into contact with the edge portion of the opening 20A from the interior of the metal tube 20. Thereafter the branch pipe forming tool 10 is fed from the interior of the metal tube 20 toward the exterior along the direction of arrow Z in FIG. 3B and moved along a prescribed track B (which is an oval path in this embodiment) along the edge portion of the opening 20*a,* thereby raising up this edge portion and forming a flared flange or branch pipe 20*b*.

Figure 4:
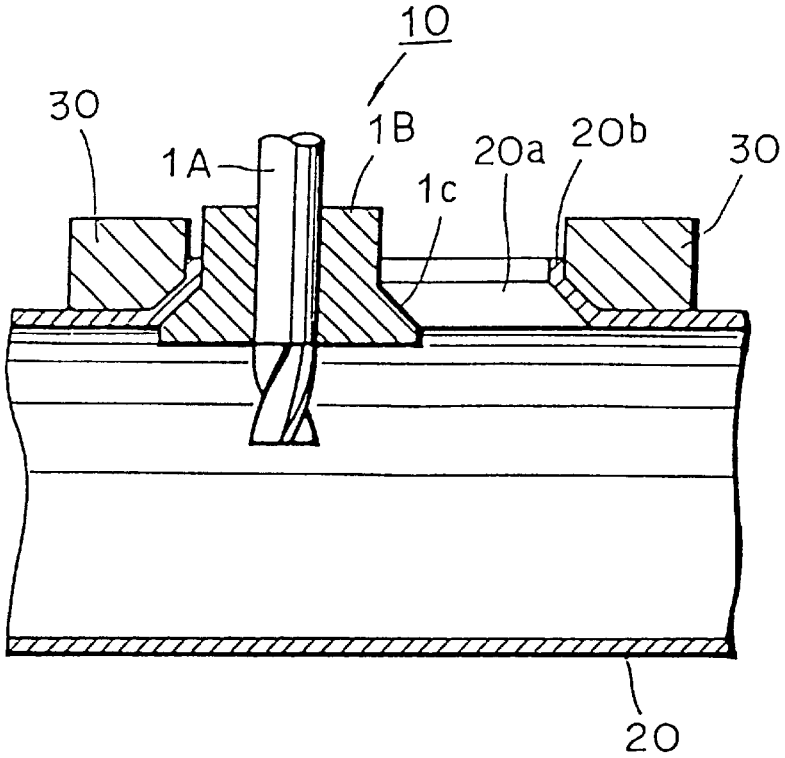
FIG. 4 is a longitudinal sectional view showing another example of the second step of the method of forming a branch pipe on a metal tube with the branch pipe forming tool according to the first embodiment of the present invention.

In order to accurately raise up the branch pipe 20*b* in the step shown in FIG. 3B, a confining tool 30 may be provided on the outer side of the metal tube 20, as shown in FIG. 4.

(Second Embodiment)

A second embodiment of a branch pipe forming tool 200 and a method of forming a branch pipe on a metal tube with the forming tool 200 according to the present invention is now described with reference to the drawings.

In the aforementioned branch pipe forming tool according to the first embodiment, a large bending moment is developed about a work chucking point (not shown) of the main shaft 1A due to a working moment which is developed in forming of the branch pipe, as shown in FIGS. 1A and 1B. In order to cope with such a bending moment, therefore, it is necessary to attain high rigidity for the main shaft 1A and the work chucking point.

Figure 5:
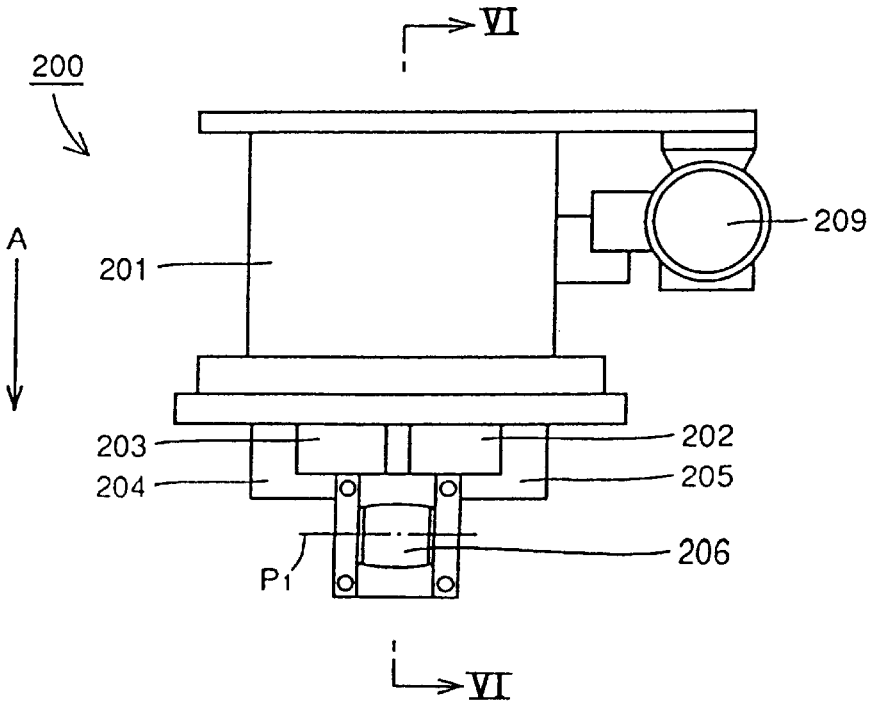
FIG. 5 is a side elevational view showing a branch pipe forming tool according to a second embodiment of the present invention.
Figure 6:
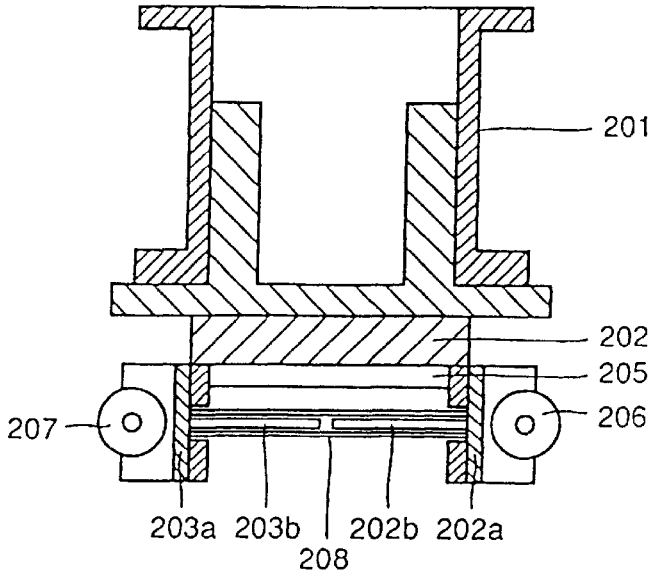
FIG. 6 is a sectional view taken along the line VI —VI in FIG. 5.
Figure 7:
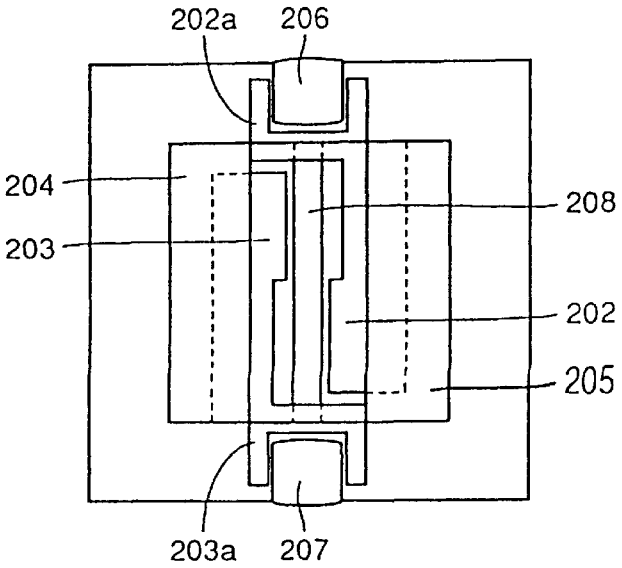
FIG. 7 is a bottom plan view of the branch pipe forming tool according to the second embodiment of the present invention.

Therefore, the structure of the branch pipe forming tool 200 according to the second embodiment is improved in the aforementioned point. With reference to FIGS. 5 to 7, the structure of the branch pipe forming tool 200 according to the second embodiment is now described.

The branch pipe forming tool 200 according to this embodiment has a base 201 which is fixed on a work chucking side. The base 201 is provided with rails 204 and 205. These rails 204 and 205 are provided with guides 202 and 203, which are slidable along the rails 204 and 205.

The guides 202 and 203 are provided with first and second support bases 202*a* and 203*a* on single ends thereof respectively. The first and second support bases 202*a* and 203*a* rotatably support first and second forming rolls 206 and 207, which are arranged on a virtual straight line at a prescribed spacing apart from one another and are directed to outer sides respectively so that peripheral surfaces thereof face toward each other.

The first and second forming rolls 206 and 207, which are shown in the form of drums in FIGS. 5 to 7, are not restricted in shape but can properly have any prescribed shape selected in response to the shape of a branch pipe which is to be formed on a metal tube.

The first and second support bases 202*a* and 203*a* are provided with a support base rotator 208 such as a rotation tube or sleeve bracket for rotating the first and second support bases 202*a* and 203*a* respectively, and are further provided with space variers 202*b* and 203*b* such as telescoping rods or bars slidingly arranged in the tube or sleeve bracket for varying the space between the first and second support bases 202*a* and 203*a*, as shown in FIG. 6.

Figure 8:
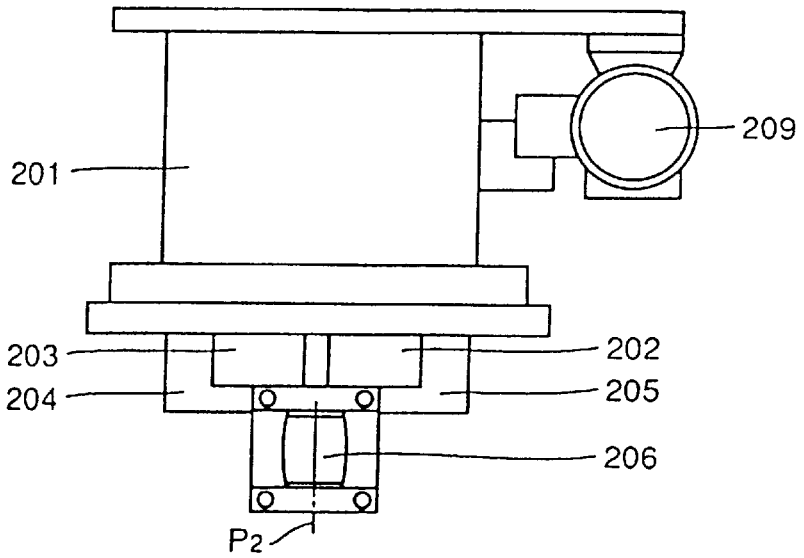
FIG. 8 illustrates the branch pipe forming tool is rotated by 90°.

The base 201 is provided with a swing motor 209 as shown in FIG. 8.

Figure 9:
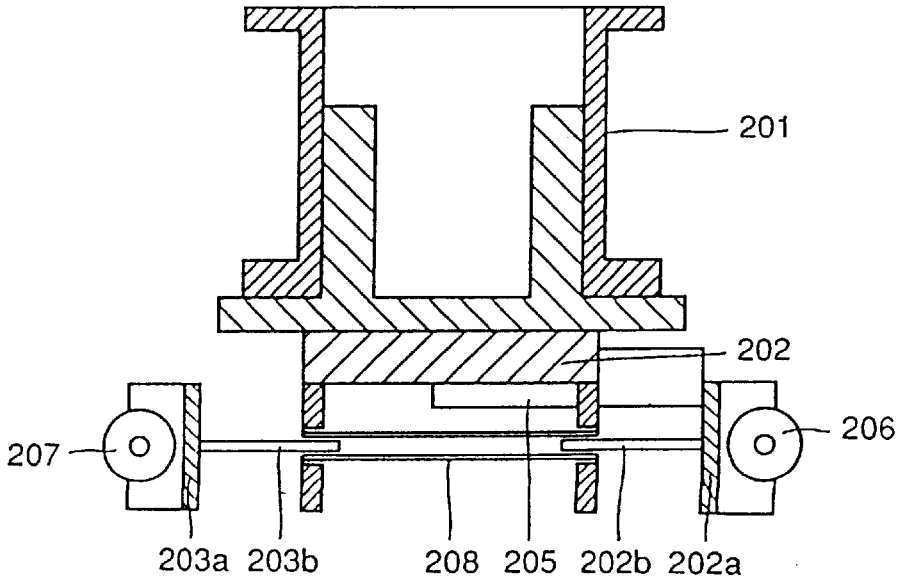
FIG. 9 illustrates the branch pipe forming tool according to the second embodiment of the present invention, with first and second forming rolls which are separated from each other at a wide spacing.

In the branch pipe forming tool 200 having the aforementioned structure, the rotation axis $P_1$ of the first forming roll 206 shown in FIG. 5 is in a direction which is perpendicular to the travelling direction (arrow A in FIG. 5) of the branch pipe forming tool 200. In the state of the branch pipe forming tool 200 shown in FIG. 8, on the other hand, the first forming roll 206 has been rotated so that the rotation axis $P_2$ of the first forming roll 206 is aligned with the travelling direction A of the branch pipe forming tool 200. Further, the first and second forming rolls 206 and 207 are at the narrowest spacing in FIG. 6, while the same are at the widest spacing in FIG. 9. These changes of the position and orientation of the forming rolls 206 and 207 are carried out via the support base rotator 208 and the space variers 202*b* and 203*b*.

Figure 10:
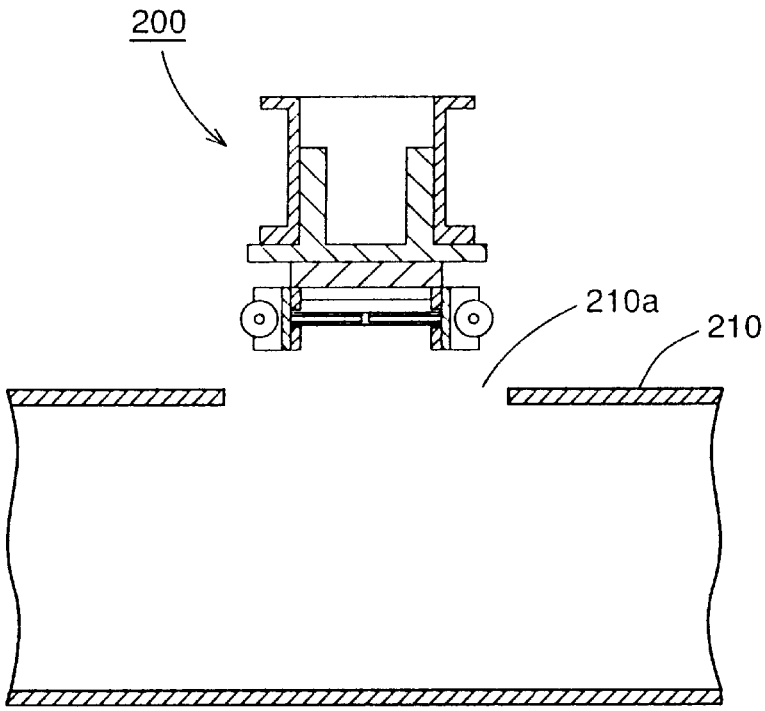
FIGS. 10 to 13 respectively illustrate first to fourth steps of a method of forming a branch pipe on a metal tube with the branch pipe forming tool according to the second embodiment of the present invention.

A method of forming a branch pipe on a metal tube 210 with the branch pipe forming tool 200 having the aforementioned structure is now described with reference to FIGS. 10 to 13. Referring to FIG. 10, the branch pipe forming tool 200 is first arranged above a prescribed opening 210*a* of the metal tube 210.

Figure 11:
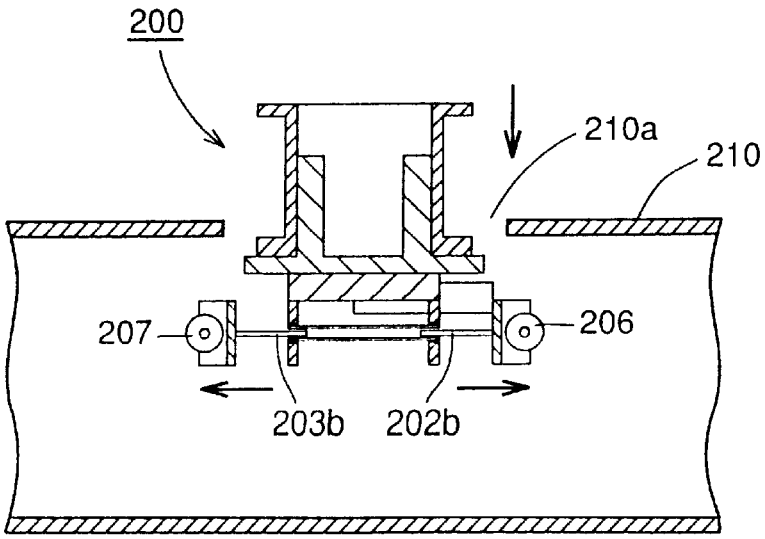

Referring to FIG. 11, the branch pipe forming tool 200 is inserted in the metal tube 210 through the opening 210*a*, and the spacing between the first and second forming rolls 206 and 207 is widened by the space varies 202*b* and 203*b* of the branch pipe forming tool 200 so t hat these rolls 206 and 207 are in contact with the edge portion of the opening 210*a* and so that the rolls 206 and 207 are respectively arranged with a horizontal rolling axis as shown in FIG. 11.

Figure 12:
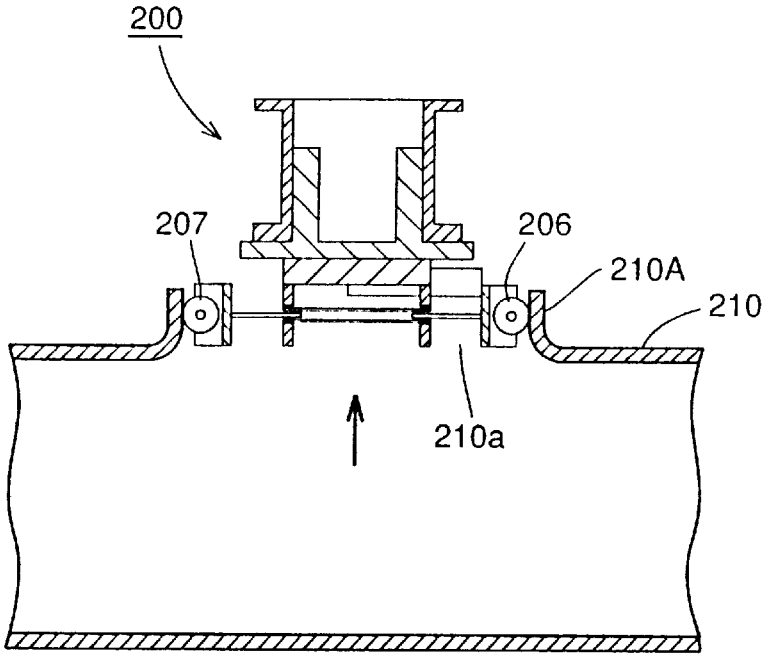

Referring to FIG. 12, the branch pipe forming tool 200 is upwardly moved while keeping the state shown in FIG. 11, thereby forming a branch pipe 210A on the metal tube 210. At this time, the reactive forces which are developed in forming of the branch pipe 210A are canceled by each other due to the arrangement of the first and second forming rolls 206 and 207 on the virtual straight line.

Thereafter the steps shown in FIGS. 11 and 12 are successively repeated and the branch pipe forming tool 200 is revolved or the metal tube 210 is rotated, thereby forming the flared flange or branch pipe 210A along the overall periphery of the opening 210*a*.

Figure 13:
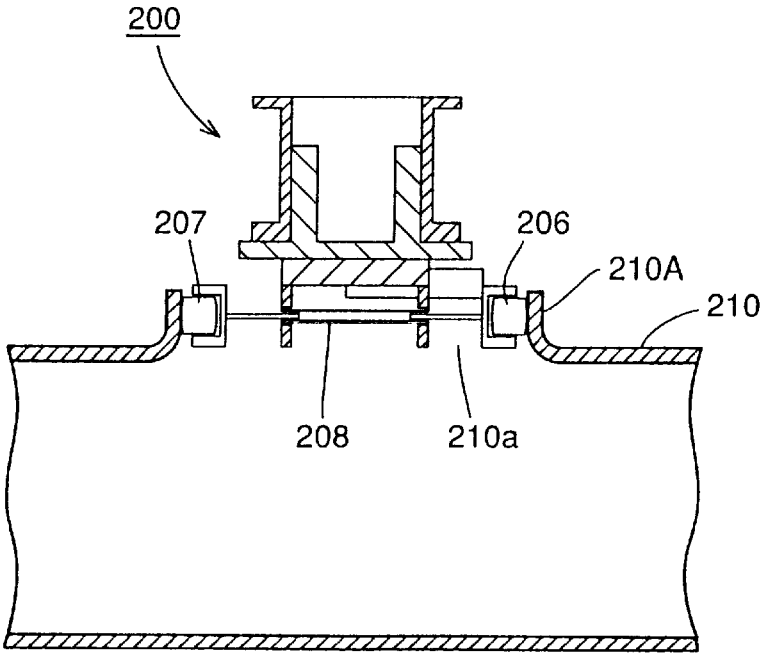

After the formation of the branch pipe 210A, the first and second forming rolls 206 and 207 are rotated by 90° through the support base rotator 208, as shown in FIG. 13. In this state, the branch pipe forming tool 200 or the metal tube 210 is revolved, while vertically moving the branch pipe forming tool 200, thereby finishing the branch pipe 210A.

Through the aforementioned steps, the flange or branch pipe 210A can be formed on the metal tube 210 so as to extend toward the exterior.

While the branch pipe 210A is formed extending toward the exterior of the metal tube 210 in the steps shown in FIGS. 10 to 13, it is also possible to alternatively form a branch pipe or flange extending toward the interior of the metal tube 210 through steps which are similar to those shown in FIGS. 10 to 13, but with the tool being pushed into rather than pulled out of the tube 210 during the branch pipe forming operation.

Figure 14:
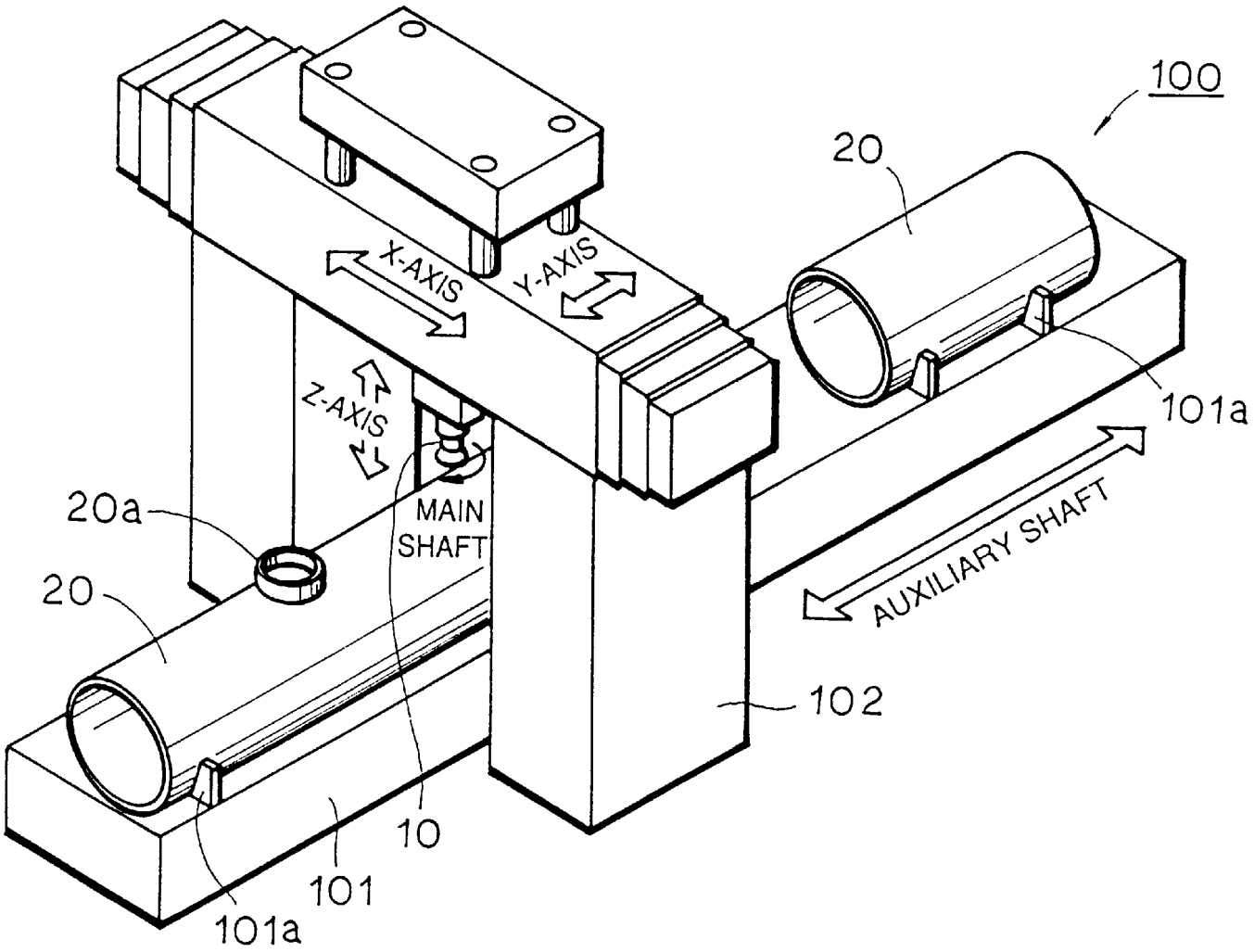
FIG. 14 is a perspective view schematically illustrating the structure of an apparatus which is employed in a method of forming a branch pipe on a metal tube using the forming tool according to the present invention.
Figure 15:
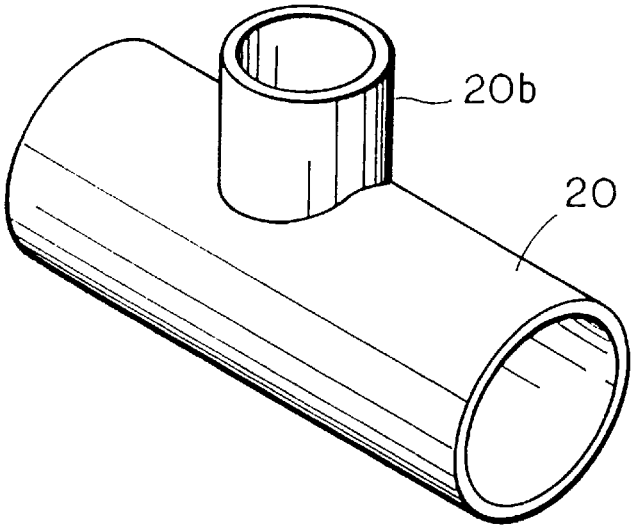
FIG. 15 PRIOR ART
FIG. 15 is a perspective view showing a metal tube having a branch pipe.
Figure 16:
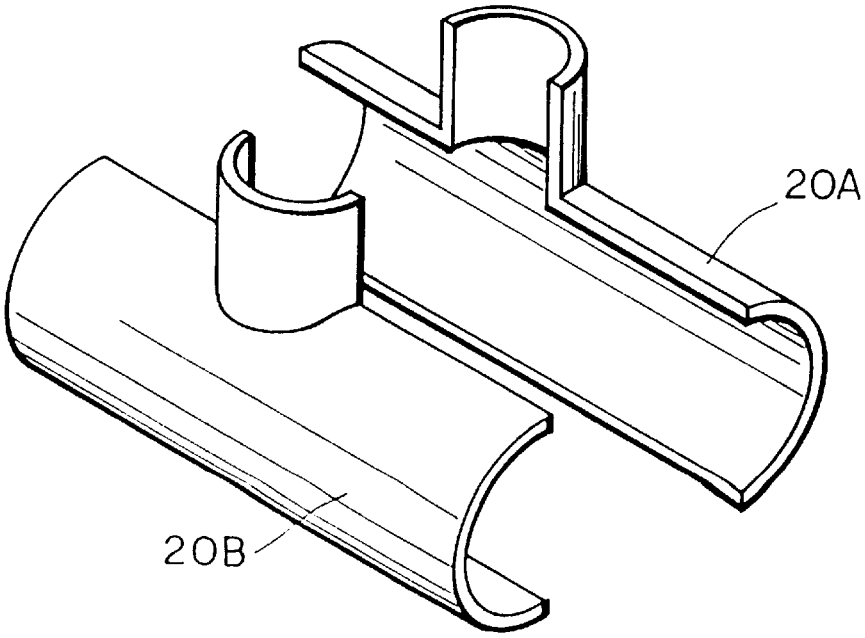
FIG. 16 PRIOR ART
FIGS. 16 to 19 respectively illustrate first to fourth conventional methods of forming branch pipes on metal tubes.
Figure 17:
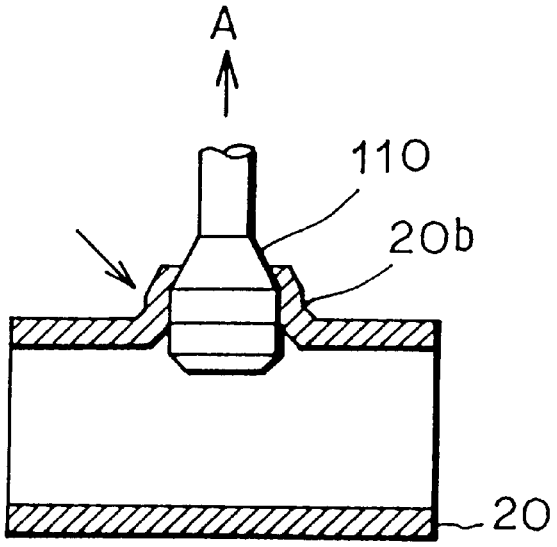
FIG. 17 PRIOR ART
Figure 18:
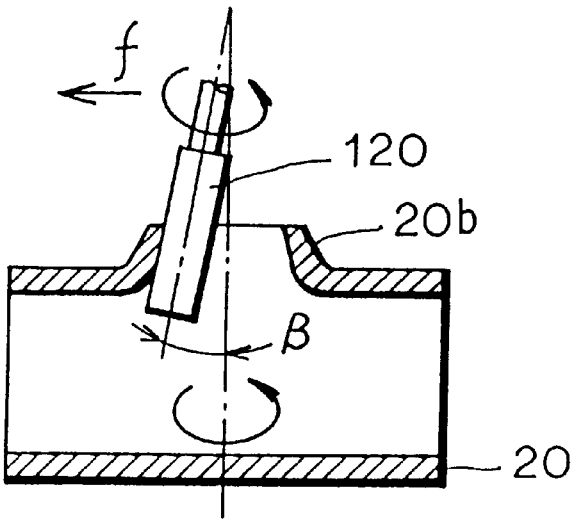
FIG. 18 PRIOR ART
Figure 19:
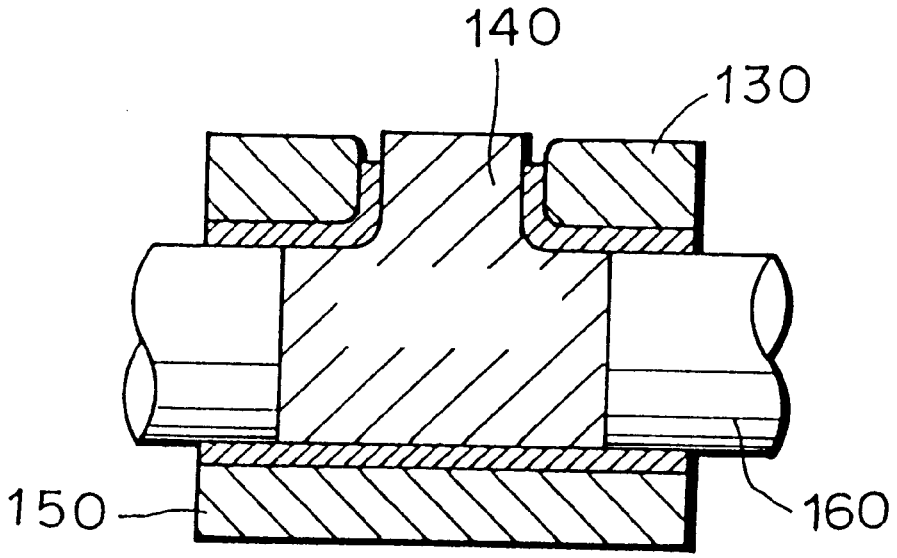
FIG. 19 PRIOR ART

With reference to FIG. 14, the structure of an apparatus 100 for imposing the prescribed movements on the branch pipe forming tool 10 or 200 and the metal tube 20 or 210 in order to implement the aforementioned steps, will now be described. First, each metal tube 20 is fixed by means of clamps or fixing metals 101*a* to a prescribed position on a base 101 which is movable along an auxiliary shaft. The branch pipe forming tool 10 is fixed to arms 102 which are movable along the X-, Y- and Z-axes respectively while rotating the branch pipe forming tool 10. Thus, the aforementioned movements of the branch pipe forming tool 10 and the metal tube 20 are enabled.

According to each of the first and second embodiments of the inventive branch pipe forming tool and the method of forming a branch pipe on a metal tube with the forming tool, as hereinabove described, the branch pipe can be formed on the metal tube through a series of operations with efficient productivity. Further, the branch pipe can be formed with extremely high accuracy by computer control, through combination with the apparatus shown in FIG. 14.

Also, the branch pipe can be formed on the metal tube by a single branch pipe forming tool, whereby M/C ability is improved and working accuracy can further be improved. Further, the branch pipe can be formed on the metal tube regardless of the size of the metal tube, whereby it is possible to form the branch pipe on the metal tube with no influences exerted by the sizes of the metal tube and the branch pipe, dissimilarly to the prior art.

According to the second aspect of the inventive branch pipe forming tool and the method of forming a branch pipe on a metal tube with the tool, the branch pipe forming tool is fed or advanced while bringing the first and second rolls into contact With the opening of the metal tube thereby forming the branch pipe on the metal tube, and then the orientations of the axes of rotation of the first and second forming rolls are rotated by the support base rotator thereby finishing the branch pipe. Thus, the first and second forming rolls which are arranged on the same virtual straight line are employed for forming the branch pipe, whereby the branch pipe can be formed while canceling working reactive forces which are applied to the branch pipe forming tool in working of the branch pipe. Consequently, the strength of the structure of the branch pipe forming tool and of a work chucking side of the branch pipe forming tool can be reduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A branch pipe forming tool useful for forming a branch pipe on a metal tube, said branch pipe forming tool comprising:

first and second forming rolls located along a rolling force axis with a spacing distance therebetween, and oriented so that peripheral surfaces thereof face toward and away from each other;

first and second support bases rotatably supporting said first and second forming rolls to be rotatable about first and second rotation axes respectively;

a variable length sliding connector between said first and second support bases allowing said support bases to be slidable along said rolling force axis thereby changing said spacing distance between said first and second forming rolls; and a rotatable connector allowing said first and second support bases to be rotatable to change a rotational orientation of said first and second rotation axes about said rolling force axis.

2. A method of forming a branch pipe on a metal tube using the branch pipe forming tool according to claim 1, said method comprising the steps of:

preparing a metal tube having a prescribed opening;

rotating said first and second support bases about said rolling force axis so that said first and second rotation axes of said first and second forming rolls are oriented perpendicular to a feed advance direction of said branch pipe forming tool;

moving said branch pipe forming tool in said feed advance direction relative to said metal tube;

sliding said first and second support bases along said rolling force axis to adjust said spacing distance so that said peripheral surfaces of said first and second forming rolls come into contact with an edge portion of said opening of said metal tube and continuing to move said branch pipe forming tool in said feed advance direction, thereby deforming said edge portion of said opening to form a branch pipe flange protruding from said metal tube through said contact with said forming rolls; and rotating said first and second support bases about said rolling force axis so that said first and second rotation axes of said first and second forming rolls are oriented parallel to said feed advance direction of said branch pipe forming tool, and then rotating said metal tube or said branch pipe forming tool relative to each other about an axis parallel to said feed advance direction for finish rolling said branch pipe flange to form said branch pipe.

3. A branch pipe forming tool useful for forming a branch pipe flange around a hole in a metal tube, comprising:

a tool base (201);

first and second forming rolls (206, 207);

first and second roll supports ( 202*a*, 203*a*) respectively rotatably supporting said first and second forming rolls so that said first and second forming rolls are respectively rotatable about first and second roll axes; and a rotation and slide platform (202, 202*b*, 203, 203*b*, 204, 205) that is connected to said tool base, and that is connected to said first and second roll supports so as to allow said roll supports to be at least partially rotatable about a pivot axis extending through said first and second forming rolls perpendicularly to said first and second roll axes, and so as to allow said roll supports to be slidingly displaceable selectively closer toward each other and farther from each other in a sliding direction parallel to said pivot axis.

4. The branch pipe forming tool according to claim 3, wherein said rotation and slide platform is connected to said tool base so as to allow said roll supports to be rotatable about a main rotation axis extending perpendicularly to said pivot axis.

5. The branch pipe forming tool according to claim 4, wherein said roll supports are each at least partially rotatable about said pivot axis between a first pivot position in which said first and second forming rolls are oriented with said first and second roll axes parallel to said main rotation axis and a second pivot position in which said first and second forming rolls are oriented with said first and second roll axes skew relative to said main rotation axis and lying in a plane that is perpendicular to said main rotation axis.

6. The branch pipe forming tool according to claim 3, wherein said rotation and slide platform comprises rails connected to said tool base, first and second guides that are respectively slidably engaged with said rails to be slidable along said rails in said sliding direction and that have said first and second roll supports respectively connected to opposite outwardly facing ends of said first and second guides, a rotation sleeve bracket extending along said pivot axis, and first and second shaft rods that are rotatably and slidably received in said rotation sleeve bracket and that are respectively connected to said first and second roll supports.

7. A method of forming a branch pipe flange on a metal tube using the branch pipe forming tool according to claim 3, comprising the following steps:

providing a metal tube with a hole in a tube wall of said tube;

moving said tool in a feed advance direction relative to said metal tube, at least partially into said hole;

rotating said roll supports about said pivot axis so as to orient said forming rolls with said first and second roll axes extending perpendicular to said feed advance direction;

sliding said roll supports along said sliding direction, so as to bring said forming rolls into contact with an edge rim of said tube wall bounding said hole, and further moving said tool in said feed advance direction so that said forming rolls deform said edge rim of said tube wall around said hole to form from said edge rim a preliminary branch pipe flange protruding from said tube wall around said hole; and rotating said roll supports about said pivot axis so as to orient said forming rolls with said first and second roll axes extending parallel to said feed advance direction, and rotating at least one of said tool and said metal tube relative to each other about an axis parallel to said feed advance direction so as to roll said forming rolls along said preliminary branch pipe flange to form therefrom a finished branch pipe flange.

* * * * *

UNITED STATES PATENT AND TRADEMARK OFFICE

CERTIFICATE OF CORRECTION

PATENT NO. : 6,000,263

DATED : Dec. 14, 1999

INVENTOR(S) : Enami

It is certified that error appears in the above-identified patent and that said Letters Patent is hereby corrected as shown below:

Col. 4, line 12, after "tool" , insert --according to the second embodiment of the present invention, with a forming roll which--.

Col. 6, line 25, after "space", replace "varies" by --variers--.

Col. 7, line 23, after "contact", replace "With" by --with--.

Signed and Sealed this

Twentieth Day of June, 2000

*Attest:*

Q. TODD DICKINSON

*Attesting Officer*

*Director of Patents and Trademarks*